United States Patent [19]

Sahm

[11] 3,976,516

[45] Aug. 24, 1976

[54] HIGH TEMPERATURE ALLOY

[75] Inventor: Peter Sahm, Neckargemund, Germany

[73] Assignee: BBC Brown Boveri & Company Limited, Baden, Switzerland

[22] Filed: Oct. 17, 1974

[21] Appl. No.: 515,695

[30] Foreign Application Priority Data

Oct. 17, 1973 Germany ..... 2351989

[52] U.S. Cl. ..... 148/32; 75/171

[51] Int. Cl.[2] ..... C22C 19/07

[58] Field of Search ..... 75/171, 170; 148/32, 148/32.5

[56] References Cited

UNITED STATES PATENTS

| | | | |
|---|---|---|---|
| 3,552,953 | 1/1971 | Lemkey et al. | 75/171 |
| 3,564,940 | 2/1971 | Thompson et al. | 75/171 |

*Primary Examiner*—R. Dean

*Attorney, Agent, or Firm*—Oblon, Fisher, Spivak, McClelland & Maier

[57] ABSTRACT

In a cast anisotropic body comprising an at least partially monovariant ternary eutectic alloy of Co, Cr and C, the eutectic part of the alloy comprising a matrix phase consisting substantially of Co containing at least Cr in a solid solution and a dispersed phase consisting substantially of a carbide of the formula $Cr_{7-x-y}Co_xMe_yC_3$ wherein $x$ is a number capable of values from 0 to 2 and $y$ is a number capable of values from 0 to 4, and wherein Me is an additional element contained in the matrix and/or dispersed phase, the dispersed phase consisting essentially of a plurality of high strength carbide fibers oriented in substantial alignment, and embedded in the matrix phase, the improvement which comprises the additional element Me being selected from the group consisting of manganese, aluminum, yttrium, boron, one or more rare earths and mixtures thereof, wherein said additional element Me is present in an amount of from 0.1 to 15% by weight based on the total weight of the composition.

3 Claims, 1 Drawing Figure

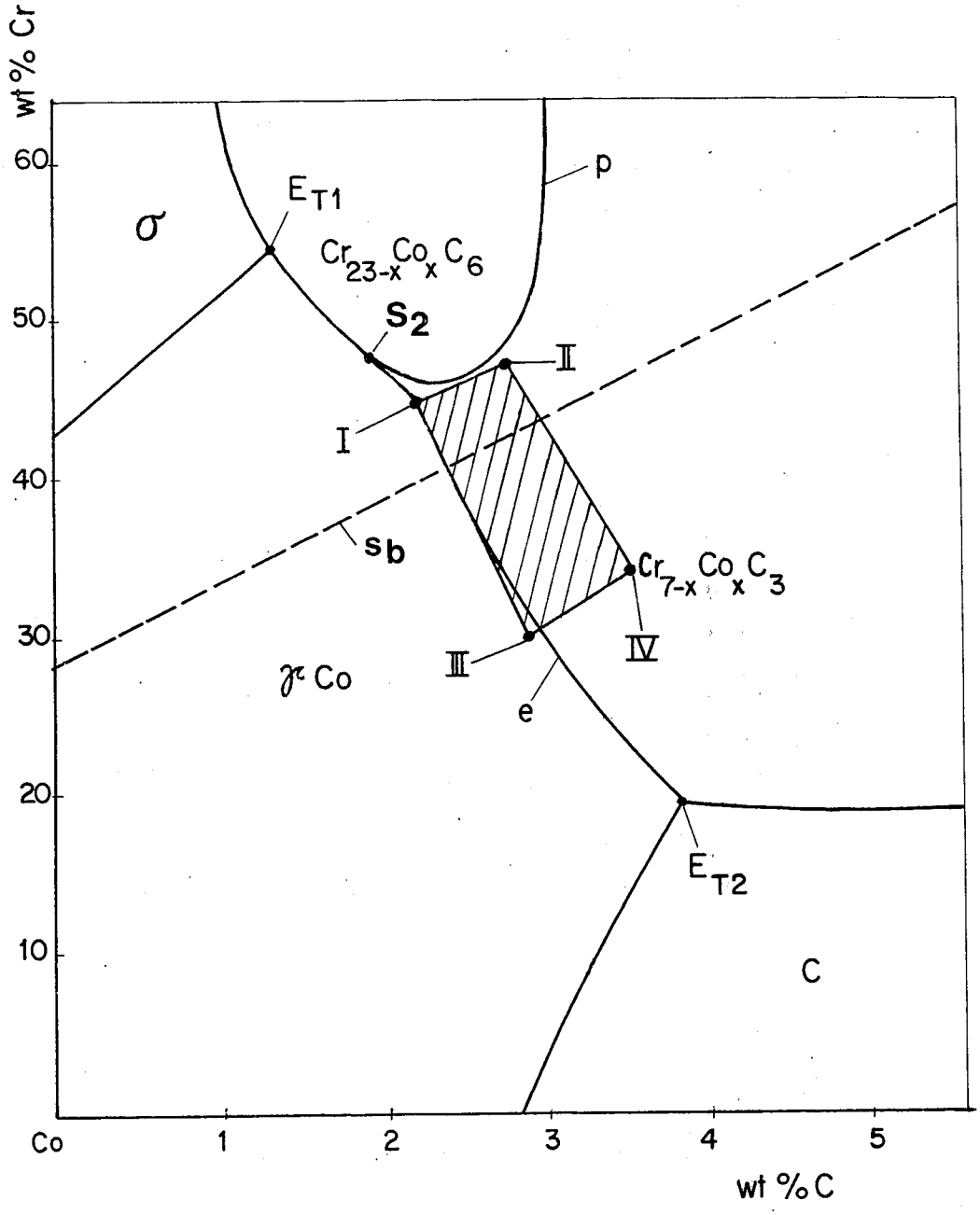
wt % Cr
60
50
40
30
20
10
σ
$E_{T1}$
p
$Cr_{23-x}Co_xC_6$
$S_2$
II
I
$s_b$
$Cr_{7-x}Co_xC_3$
IV
III
γ Co
e
$E_{T2}$
C
Co
1
2
3
4
5
wt % C

HIGH TEMPERATURE ALLOY

BACKGROUND OF THE INVENTION

1. Field of the Invention

This invention relates generally to alloys which are characterized by high temperature strength characteristics, and more particularly to alloys of the Co-Cr-C type.

2. Description of the Prior Art

Unidirectional solidification of lamellar eutectic alloys is know in the art, as indicated in *Kraft* U.S. Pat. No. 3,124,452, or Giessereiforschung 24 (1972) pp. 45–53, for instance. That technique refers to a process in which the alloy is partially melted to form a liquid-solid interface or solidification front. The interface is caused to be moved in a unidirectional fashion as the alloy is cooled through an appropriate temperature. In this way the crystallites of each phase grow or form normal to the solidification front parallel to the direction in which the solidification front moves relative to and through the alloy. The conditions of unidirectional solidification can be determined by the following equation in which the ratio of temperature gradient G and growth rate $v$ is determined by $$\frac{G}{v} > \frac{m}{D} \cdot \Delta c + K_i C_i$$

wherein $m$ is the slope of the liquidus line in the usual temperature phase diagram at the point determined by the melt composition, $D$ is the diffusion coefficient of the liquid atoms, $\Delta c$ is the compositional deviation of the melt composition from eutectic composition and $K_i C_i$ is a constant governed by the impurity concentration $C_i$. Fulfillment of this condition serves to prevent the formation of dendrites or cell boundaries.

The melt is convectionless with no thermal fluctuations at the interface, in order to prevent the formation of growth bands or other growth defects.

This technique has been applied to Co-Cr-C alloys in the prior art. For instance, *Thompson*, U.S. Pat. No. 3,564,940, and German publication 1,928,258 report an alloy of the composition 35–45% wt Cr, 2.2–2.6% wt C and 52.4–62.8% wt Co. The Co-Cr-C alloys of the *Thompson* patent are aligned polyphase structures which solidify according to the monovariant eutectic structure: at a fixed pressure these compositions are monovariant thermodynamically and involve, in ternary systems for example, the three phase equilibrium between the melt and two solids over a temperature and composition range and not, as in the binary or pseudo-binary systems, at a fixed temperature and composition. Those compositions are located on a eutectic trough.

However, the alloys reported in *Thompson* are generally characterized by unsatisfactory strength characteristics, particularly time-dependent creep strength, and, therefore, the range of application of such alloys is limited. Although that prior patent indicates that its composition had a contemplated utility in the formation of gas turbine blades, in practice, those alloys have not been found to be sufficiently satisfactory.

Efforts had thus been made to improve the strength properties of this system of alloys, without success. For instance, methods are known in the present field of the art for improving the high temperature strength characteristics, but not without sacrifice of other properties, such as corrosion resistance.

*Lemkey et al* U.S. Pat. No. 3,552,953, discloses another Co-Cr-C alloy of the composition 45.2 – 49.2% wt Co, 49 – 53% wt Cr and about 1.87% wt C which is unidirectionally solidified such that a carbide of the formula $Cr_{23}C_6$ is dispersed in a skeletal distribution in the matrix phase. This type of alloy, however, is quite different from the alloy of the present invention.

A need continues to exist for a technique of improving the high temperature strength characteristics of Co-Cr-C alloys, without sacrifice of other desirable properties of the alloy, particularly without sacrifice of corrosion resistance.

SUMMARY OF THE INVENTION

Accordingly, it is one object of this invention to provide a Co-Cr-C alloy which is characterized by excellent high-temperature strength properties without sacrifice of such other alloy properties as corrosion resistance.

This and other objects of this invention as will hereinafter become more readily understood by the following description, have been attained by providing an anisotropic body comprising an at least partially monovariant ternary eutectic alloy of Co, Cr and C, the eutectic part of the alloy comprising a matrix phase consisting substantially of Co containing at least Cr in a solid solution and a dispersed phase consisting substantially of a carbide of the formula $Cr_{7-x-y}Co_xMe_yC_3$ wherein $x$ is a number capable of values from 0 to 2 and $y$ is a number capable of values from 0 to 4, and wherein Me is an additional element contained in the matrix and/or dispersed phase, the dispersed phase consisting essentially of a plurality of high strength carbide fibers oriented in substantial alignment, and embedded in the matrix phase, the improvement which comprises the additional element Me being selected from the group consisting of manganese, aluminum, yttrium, boron, one or more rare earths and mixtures thereof, wherein said additional element Me is present in an amount of from 0.1 to 15% by weight based on the total weight of the composition.

One or more additional elements selected from the group consisting of Mn, Al, Y, B or a rare earth is used to replace Co and/or Cr in quantities of 0.1 to 15% wt.

BRIEF DESCRIPTION OF THE DRAWINGS

A more complete appreciation of the invention and many of the attendant advantages thereof will be readily attained as the same becomes better understood by reference to the following detailed description when considered in connection with the accompanying drawing, the sole FIGURE of which is a phase diagram showing the compositional range with which the present invention is principally concerned.

DETAILED DESCRIPTION OF THE PREFERRED EMBODIMENTS

In the alloy of this invention, the matrix is composed predominantly of Co and Cr, and possibly some carbon, generally in the well-known crystallographic form of $\gamma$ Co solid solution, while the fibrous dispersed carbide phase is predominantly of the type $Cr_7C_3$ which is the chromium carbide appearing purely in the binary Cr-C marginal system of the present basic ternary Cr-Co-C system and having the same crystallographic structure as the carbide $Cr_{7-x-y}Co_xMe_yC_3$ in the preferred compositional ranges of the present invention. Essential to this invention is the use of certain other metals or elements which are added into the composition, either appearing in the matrix and/or in the carbide phase in quantities from 0.1% wt to 15% wt based on the total weight of the alloy.

Suitably such additional elements are Mn, Fe, Al, Y, B or the rare earths, particularly La, Ce, Pr, Nd, Pm, Sm, Eu, Gd, Tb, Dy, Ho, Er, Tm, Yb and Lu, or mixtures thereof.

The preparation of the alloy body of this invention is by directional casting techniques as described by *Thompson*, supra, *Kraft*, supra, or Giessereiforschung, supra.

The microstructure of the body according to the present invention will show a carbide phase in fibrous or fibrillar form embedded in a matrix. The aspect ratio i.e. the ratio of the length to the diameter of the fibres preferably is greater than or equal to 50, and the fibers will predominantly have a thickness of about 0.1 to 3 $\mu$. Up to 49% of the fibers, however, may have a thickness dimension and/or length to thickness ratio (aspect) other than as above indicated.

The fibers embedded in the matrix may have a length of at least 0.1 mm up to the length of the casting, although lengths of from 1 mm up to the length of the casting are preferred.

It is also significant that the carbides which are embedded into the matrix are directionally oriented in an essentially, mutually parallel configuration. This is achieved by directionally solidifying the melt by the technique mentioned supra as known per se.

The composition of the carbide will have essentially the formula:

$$Cr_{7-x-y}Co_xMe_yC_3$$

wherein $x$ and $y$ are numbers which may assume values from 0 to 2 respectively from 0 to 4.

The carbide fibers may have substituted therein a quantity of an additional element or a mixture of elements mentioned supra.

The alloys of the present invention and their properties will be understood in detail more readily in the light of the following description with reference to a selected part of the primary crystallization phase diagram of the ternary Cr-Co-C system as represented schematically in the enclosed drawing.

Considering the following remarks it has to be kept in mind that the pure ternary Cr-Co-C system as partly represented in the drawing is merely the basic alloy to be used with the specific additional alloy elements according to the present invention. Generally speaking, it can be said that the characteristic phase limits of the said basic phase diagram, and particularly the primary crystallization phase limits appearing in the liquidus surface of the three-dimensinal phase diagram, as well as the corresponding solidification phase reactions basically maintain their typical form and position in the ternary Cr-Co-C diagram when the additional elements of the present invention are incorporated into the alloy, particularly in replacement of Cr and/or Co. For this reason it is justified to explain and characterize the basic alloy part of the complete alloys according to the present invention by useful and sufficient approximation in the said basic ternary diagram.

Turning now to the enclosed diagram, this representation has to be understood as a section of the complete ternary diagram including the Co corner of the diagram. Accordingly, the Cr and C content in weight percentage have been marked along the ordinate and abscissa, respectively, starting from the Co corner.

In the diagram there are different primary crystallization regions well-know per se, mainly the solid solution regions G and C which are of no interest in the present connection, further the chromium-richer carbide region $Cr_{23-x}Co_xC_6$ which is at most of minor interest in so far as this chromium-richer carbide for certain marginal compositions may exist in minor amounts in the dispersed phase besides the main carbide dispersed phase $Cr_{7-x}Co_xC_3$, the letter being the primary crystallization phase area of main interest for the present invention, and finally the solid solution primary crystallization region $\gamma$Co being also of interest for the present invention.

All the lines between the different primary crystallization regions except the line $p$, which represents a peritectic trough, indicate eutectic troughs well-known in the art, for instance from the *Thompson* and *Lemky* specifications supra. Of substantial interest for the present invention is the eutectic trough $e$ which extends from above trough a first nonvariant eutectic point $E_{T1}$ and a second nonvariant eutectic point $S_2$ defined as the triple point between the three regions $Cr_{23-x}Co_xC_6$, $Cr_{7-x}Co_xC_3$ and $\gamma$Co, to a third nonvariant eutectic point $E_{T2}$ defined as the triple point between $Cr_{7-x}Co_xC_3$, $\gamma$Co and C. In this connection it may be of interest that it was not agreed to before the latest inquiries that the eutectic reaction in the Co-Cr-C system really does occur in a compositional point where the peritectic trough $p$ joins the eutectic trough $e$.

Now going further into details, compositions in the nearer or farther vicinity of the section of the eutectic trough $e$ between the eutectic points $S_2$ and $E_{T2}$ are of major interest as basic alloys for the present invention. In this connection it has to be kept in mind that all the compositions being exactly on this section of the eutectic trough $e$ lead to simultaneous solidification of $\gamma$Co and $Cr_{7-x}Co_xC_3$ resulting in the well-known very fine grained eutectic structure, while any compositional deviation from the eutectic trough leads to primary crystallization of $\gamma$Co on the one side and of $Cr_{7-x}Co_xC_3$ on the other side.

The carbide phase solidifies in a fibrous or similar crystal structure for alloy compositions exactly in the eutectic trough as well as on the carbide side thereof, i.e. in the $Cr_{7-x}Co_xC_3$ area, thus rendering structures in principle useful for the present invention. However, the amount of carbide solidified as a part of the eutectic, that means simultaneous with, and dispersed in the matrix phase has a very much finer crystal structure with a smaller fiber diameter compared with the amount of carbide which, due to an alloy composition on the carbide side of the eutectic trough has solidified from the melt by primary crystallization before the remaining melt attains the eutectic composition. Therefore, alloy compositions in the eutectic trough or quite near to it on the carbide side are the preferred ones for the present invention, while, in practice, considerable deviations into the carbide primary crystallization area are tolerable and even useful as well. To a certain extent, the primary carbide fibers with their greater diameter contribute favorably to the high mechanical strength of the alloy, while the specific additional alloy elements of the present invention are preserving the useful properties which might be otherwise affected by the coarser carbide fiber structure. This holds true particularly for corrosion resistance, creep strength, and other important properties of alloys of the present invention.

Compositional deviations from the eutectic trough into the solid solution region, i.e. generally into the $\gamma$Co primary crystallization region are accompanied by formation of dendrites which is usually undesired and tolerable only to minor degrees.

Therefore, summarizing it can be stated that the best mode of operation of the present invention uses basic alloys with compositions on the eutectic trough e between the non-variant eutectic points $S_2$ and $E_{T2}$ including compositions deviating slightly from the correct eutectic one, while compositional ranges still useful comprise comparatively small deviations from the eutectic trough into the Co solid solution primary crystallization region on the one hand and considerably greater deviations into the carbide primary crystallization region on the other hand.

Occurence of the $Cr_{23-x}Co_xC_6$ carbide in the dispersed phase within the eutectic part of the alloy should generally be avoided because of the brittle character of this carbide. However, small amounts of this carbide besides the $Cr_{7-x}Co_xC_3$ carbide occurring in the vicinity of the peritectic trough P may be tolerable.

By the way, suffice to remark that the foregoing explanation mentioned the carbide formula $Cr_{7-x}Co_xC_3$ with reference to the basic alloy, i.e. without additional elements Me and $y = 0$.

Now turning further to the details of the best mode of operation of the present invention, most favourable results have been obtained by combining the above-mentioned additional elements with basic alloy compositions within a region of the basic ternary Cr-Co-C diagram defined by the following corner compositions:

| | | | |
|---|---|---|---|
| I. | Co-Me = 53.1 % | Cr-Me = 44.7 % | C = 2.2 % |
| II. | 50.25 | 47 | 2.75 |
| III. | 67.15 | 30 | 2.85 |
| IV. | 62.5 | 34 | 3.5 |

This compositional region with the corner points I to IV has been pointed out by shading in the enclosed drawing.

Of particular interest for the present invention are basic alloys with compositions on the line $s_b$ in the diagram. This line represents a pseudo-binary cut within the present ternary system, this pseudo-binary cut behaving like a binary eutectic with $\gamma$Co and $Cr_{7-x}Co_xC_3$ as the partner of a eutectic reaction represented by the section of the said line $s_b$ with the eutectic trough *e*.

As to the diagram it should be kept in mind that the phase boundary lines are a schematic representation which in one or the other section eventually could and will be amended in view of future research and measurements. Nevertheless, the diagram is held to be fully sufficient in explaining and identifying the basic alloys for use with the present invention.

As stated supra the eutectic alloy for use with the present invention preferably consists of $\gamma$Co as the matrix phase and $Cr_{7-x}Co_xC_3$ as the dispersed phase, and it is an important aspect of the present invention that the additional elements will be incorporated in the matrix and/or the dispersed phase during solidification.

In detail the effects of the additional elements are the following ones:

Boron is a desirable substituent to be added to the composition, either in the carbide or in the matrix, because it can improve interstitial hardening. Boron also acts to refine the grain and the phase boundaries.

Through accumulation in the grain boundaries a general consolidation is attained which has a favorable effect on the time dependent creep strength. Particularly good results are attained when the boron is present in amounts of 0.005% to 0.5% wt. Beyond 0.5%, the strength of the composition tends to be reduced due to a coarsening of the fiber structure. Mn and/or Al may also be added to improve strength properties, although larger quantities of Mn or Al would be needed, as compared with the smaller quantity of boron which will provide similar effects.

Yttrium may be added for the same purpose, however, it achieves this effect indirectly, by increasing oxidation resistance.

A combination of metals such as boron and aluminum have proven to be quite effective. In this instance, the boron should be present in amounts of 0.001 to 0.006% and aluminum from 1 to 3%. To this can also be added yttrium in amounts of 0.1 to 0.8%.

These alloys will become partly dissolved in the matrix and partially in the carbide, interstitially as well as substitutionally, to enhance hardening. The effect of the additive metals also seems to be an enhancement in corrosion resistance, particularly when aluminum or yttrium are used.

Manganese may also be used as an alloying metal to increase the strength of the carbide fibers, since it goes extensively into solution in the carbide so as to cause a solution hardening effect. Manganese can be used in amounts of up to 10% wt. Above 10% wt, the fiber structure is adversely affected.

Aluminum, on the other hand, will tend to smooth the fiber morphology and thereby increase the strength of the fiber by creating a morphology having fewer stress points. In larger amounts, the aluminum tends to enhance the corrosion resistance of the composition. Quantities of 0.1 to 3% appear to be optimal, since about 3% the structure of the fiber becomes undesirably altered.

Yttrium, or the rare earths, particularly Cerum-Mischmetal, act mainly to stabilize the passivation layer on the surface of the casting, and thereby provides added protection for compositions intended for use in highly corrosive environments. These metals thus have an indirect effect on the time dependent strength. Good results are attainable when these metals are used in amounts of 0.1 to 2.5% wt. Beyond about 2.5% the fiber structure, as well as the casting properties, change disadvantageously.

Having generally described the invention, a more complete understanding can be obtained by reference to certain specific examples, which are included for purposes of illustration only and are not intended to be limiting unless otherwise specified.

EXAMPLE

The values in the following tables were obtained with specimens of composition given in the tables and produced as follows:

TABLE 1

| Alloying metal % by wt | Co | Cr | C | Mn | B | Al | Y | Tensile Strength at 1000°C (MN/m²) |
|---|---|---|---|---|---|---|---|---|
| Basic Alloy | 56.9 | 40.7 | 2.4 | — | — | — | — | 480 |
| Example 1 | 45 | 46.8 | 3.5 | 4.7 | — | — | — | 610 |
| Example 2 | 40 | 46.8 | 3.5 | 9.7 | — | — | — | 630 |
| Example 3 | 56.8 | 40.7 | 2.4 | — | 0.1 | — | — | 590 |
| Example 4 | 54.9 | 40.7 | 2.4 | — | — | 1 | 0.5* | 620 |

*0.5% Ce-Misch Metal added

TABLE 2

| Alloying metals | Co | Cr | C | Mn | B | Al | Y | Temperature-Dependent Creep Strength at 1000°C and 150 MN/m² Load (Stress) Rupture time (hours) |
|---|---|---|---|---|---|---|---|---|
| Basic alloy | 56.9 | 40.7 | 2.4 | — | — | — | — | 100 |
| Example 1 | 55.9 | 39.7 | 2.4 | — | — | — | 2 | 270 |
| Example 2 | 56.795 | 40.7 | 2.4 | — | 0.005 | 0.1 | — | 135 |
| Example 3 | 56.9 | 39.348 | 2.25 | — | 0.002 | 1.5 | — | 135 |
| Example 4 | 56.9 | 38.7 | 2.4 | — | — | 2 | — | 160 |

The indicated ingredients were melted after weighing, in an alumina crucible and brought into the desired mold, e.g. rod-shaped mold, by a vacuum drawing method. Directional solidification proceeded in an inert gaseous atmosphere with solidification velocities of about 7 cm/hr and temperature gradients around 100°K/cm. After this, the specimens were brought into the desired shape (here rods of 5mm diameter and 60 mm length) by free cutting machining. By the indicated method, the fibers are directed parallel to the rod axis. As the tables show, the increase in tensile strength and time-dependent creep strength at high temperatures compared to the basic alloys is considerable. It can be understood by reference to the tables that improvement in the tensile strength by as much as 30% is obtained by the presence of Mn and Al in the composition. The usable life of the compositions is improved by as much as 100%, of. Table 2.

Table 2 shows the especially favorable effect on useable life when yttrium is present. This effect is believed to be a result of the observation that corrosion resistance of the material is increased and a reduction in the specimen rod's cross-section resulting from oxidation is obtained.

Having now fully described the invention, it will be apparent to one of ordinary skill in the art that many changes and modifications can be made thereto without departing from the spirit or scope of the invention as set forth herein.

What is claimed as new and intended to be covered by Letters Patent is:

1. In the cast anisotropic body comprising an at least partially monovariant ternary eutectic alloy of Co, Cr and C, the eutectic part of the alloy comprising a matrix phase consisting essentially of Co containing at least Cr in a solid solution and a dispersed phase consisting essentially of a carbide of the formula $Cr_{7-x-y}Co_xMe_yC_3$ wherein $x$ is a number capable of values from 0 to 2 and $y$ is a number capable of values from 0 to 4, and wherein Me is an additional component contained in the matrix and dispersed phase, the dispersed phase consisting essentially of a plurality of high strength carbide fibers oriented in substantial alignment, and embedded in the matrix phase, the improvement which comprises the additional component Me being aluminum in amounts from 0.1 to 3% by weight based on the total weight of the composition.

2. The body of claim 1, wherein the matrix phase comprises predominantly $\gamma$Co.

3. The body of claim 1, wherein the final composition in percent by weight is within the relative three-component system of cobalt, chromium, carbon:

| | | | |
|---|---|---|---|
| 1. Co, Me = | 53.1 % | Cr, Me = 44.7% | C = 2.2 % |
| | 50.25% | 47 % | 2.75% |
| | 67.15% | 30 % | 2.85% |
| | 62.5 % | 34 % | 3.5 %. |

* * * * *